US005814746A

United States Patent [19]

Stafford

[11] Patent Number: 5,814,746

[45] Date of Patent: Sep. 29, 1998

[54] PITCH MODIFYING GUITAR BRIDGE ASSEMBLY

[76] Inventor: Bobby Joe Stafford, HC67 Box 85 Locust Grove, Oklahoma, Okla. 74352

[21] Appl. No.: 699,706

[22] Filed: Jul. 2, 1996

[51] Int. Cl.[6] ..... G10D 3/04

[52] U.S. Cl. ..... 84/313; 84/312 R; 84/297 R

[58] Field of Search ..... 84/313, 312 R, 84/327, 297 R, 267, 298, 299

[56] References Cited

U.S. PATENT DOCUMENTS 4,354,417 10/1982 Glaser, II ..... 84/312 R 4,763,555 8/1988 Minakuchi et al. ..... 84/313

*Primary Examiner*—Cassandra C. Spyrou

[57] ABSTRACT

The pitch changer is mounted in a cavity in the backside of a Spanish Guitar and incorporates a bell-crank lever of which one end protrudes out of cavity through a hole in cover and lays parallel along the backside of the guitar, with its strap attach end pointing towards the neck. This lever when pulled by the guitarist, which is attached to his belt by some sort of strap, engages other levers which have the guitar strings attached, thus stretching them to a higher pitch, one-half or full step, against a recessed step in guitar body. This is accomplished by a linkage system of rocker plates and wires which is connected between the two lever systems. Adjustable stop means are provided to limit the movement of the levers which have the strings attached, thus enabling the control of the high and low pitch. The tension of the guitar strings pulls levers back to their low positions when bell-crank lever is released by guitarist.

3 Claims, 4 Drawing Sheets

PITCH MODIFYING GUITAR BRIDGE ASSEMBLY

BACKGROUND OF THE INVENTION

1. Field of the Invention

This invention relates to the field of Spanish Guitars that are fitted with devices adapted at the will of the guitarist to change the pitch of one or more strings by a predetermined increment.

2. Description of Prior Art

Another U.S. Pat. No. 4,354,417 was issued Oct. 19, 1982 to Joseph Glaser II for a device which has multiple levers for raising the pitch of selected strings, which requires a cumbersome harness and awkward guitar motions to activate, for example: the lever requires pushing the neck of the guitar away another lever requires pushing the neck downward, an additional lever 30 requires pulling the guitar towards the guitarist.

It would be impossible to raise the pitch of string #2 and string #5 at the same time since the levers are activated in opposite directions. Also the guitarist would have to wear some type of rigid device on his person adjacent to the additional lever to keep the extension from sinking into his stomach, due to the strong pressure exerted on this lever by string #5.

Glasers assertion that his device can be moldified so that the action of one lever. Varies the tension in more than one guitar string is true, but only one of the strings high pitch could be controlled due to the location of limiter stops. They are located to control movement of some levers and not all levers. It also appears that the guitar would require a special made carrying case due to the protruding levers on the back side of the guitar dr disassembly.

The activation lever of present invention lies against the back side of the guitar and will fit into conventional made carrying cases.

Another feature of present invention is if a guitarist does not desire a selected string to be raised to higher pitch, tuning screw can be screwed down pushing arm of lever against step 24 in body cutout thus disabling its movement.

SUMMARY OF THE INVENTION

The object of the invention is to create sounds identical to that of a pedal steel guitar by stretching the strings and still maintain the Spanish Guitar tuning and playability. This mechanism has greatly enhanced characteristics relative to tunability, adjustability, wear, and other factors. This is accomplished by the lever linkage, location of tuning screws, and other less complex components described and recited in the appended claims.

DETAILED DESCRIPTION OF THE DRAWINGS

Figure 1:
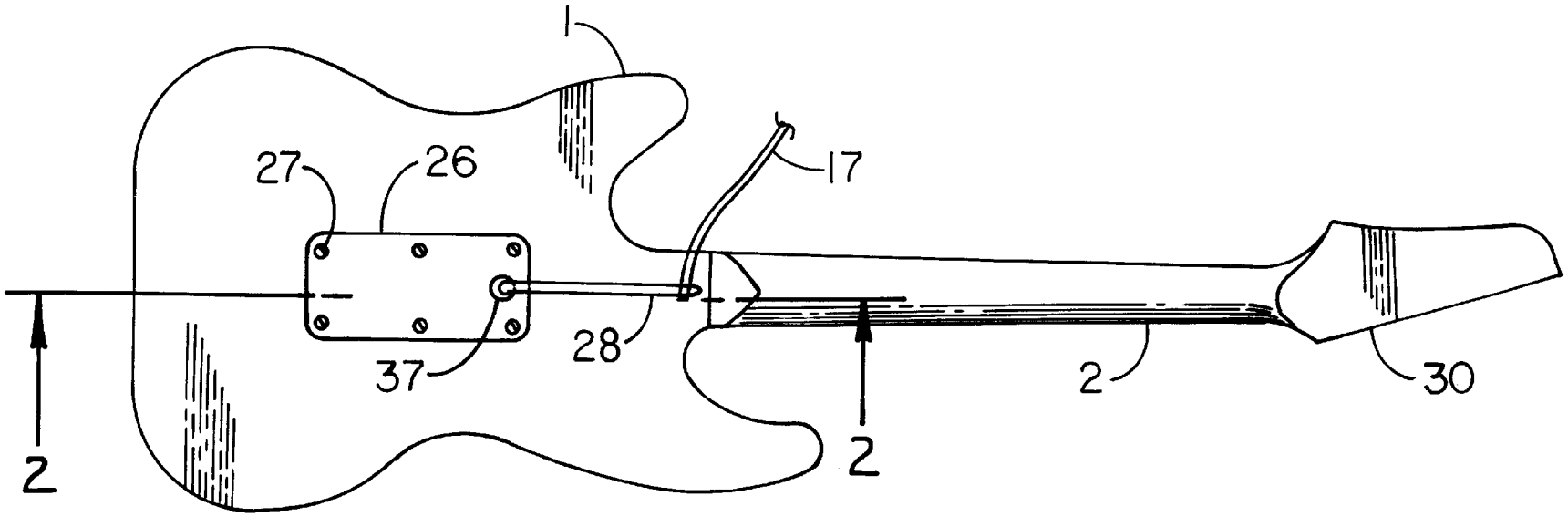
FIG. 1 is a plan view of the backside of a Spanish Guitar incorporating the belt strap-operated pitch changing device.

Referring to FIG. 1 the mechanism is located in a cavity in the backside of the guitar body 1, said guitar having a neck 2, at the outer end of which is provided a head 30. The body 1 is, in the present illustration a solid wooden body (or plastic), although the invention may be fitted in hollow body guitars. Body 1 has a face and a back which lie generally in parallel planes to which neck 2 is also generally parallel, it being understood that the appended claims also apply to guitars wherein the generally parallel face and back are contoured. A plurality of generally parallel strings, normally six, are disposed over the neck 2 and over the face of body 1. The tension on such strings are regulated by tuning keys (not shown) located on head 30.

Figure 2:
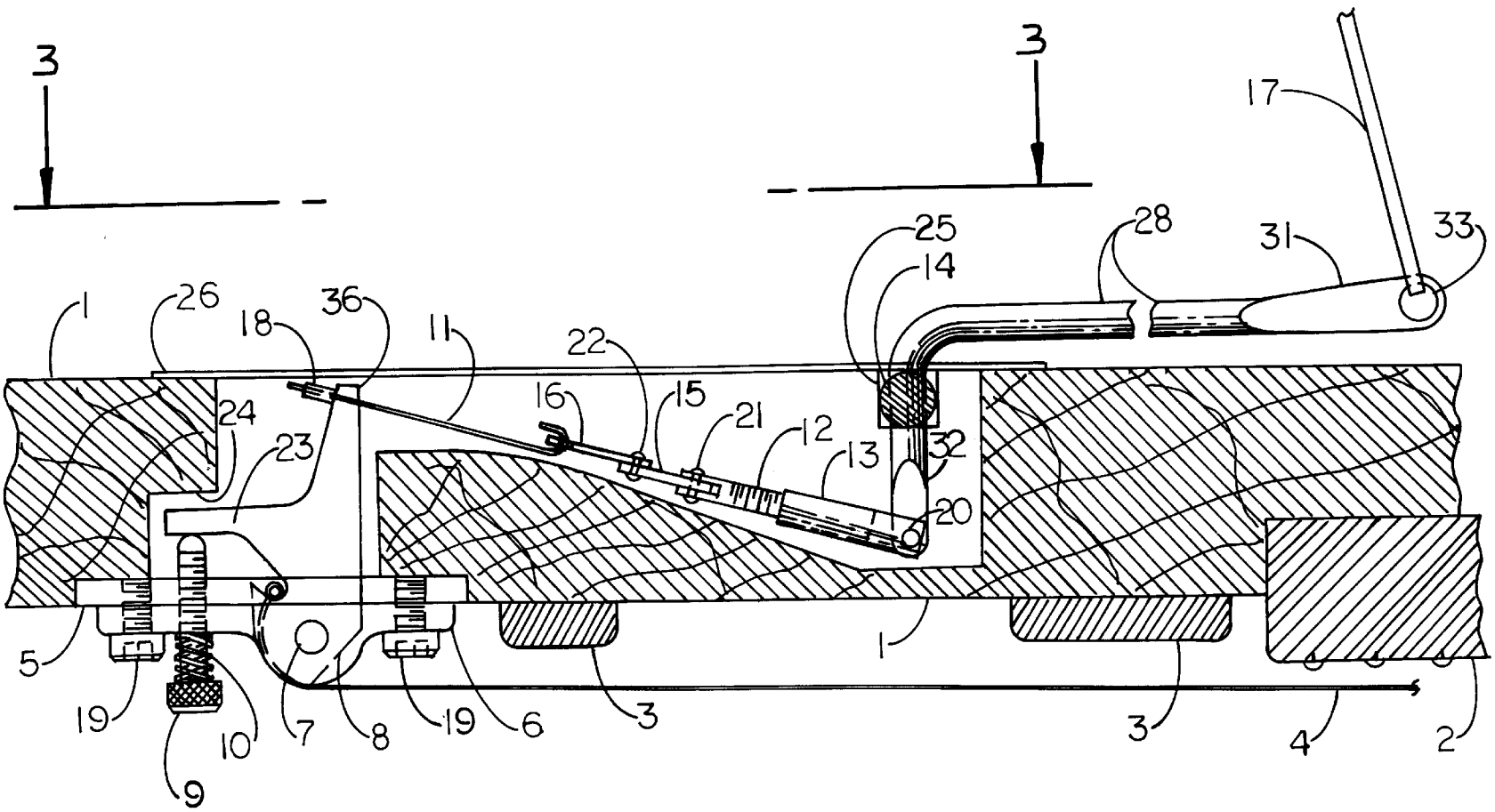
FIG. 2 is a sectional view taken along line 2—2 of FIG. 1 showing components located in a routed cavity of the guitar body prior to being pulled on by the guitarist.

It is a feature of the present invention that the majority of the components of one mechanism are recessed into the backside of body 1, and in a recess that is sufficiently small that the body 1 is not weakened substantially, but instead may readily withstand the stresses imposed by the strings of the guitar. The recess in body 1 is numbered 29 in FIG. 3, and is located between the neck 2 and the bridge area. Over the recess is a cover 26 held in place with screws 27, with a hole 37 in it to allow arm 31 of bell-crank 28 to pass through and lay alongside and parallel to body 1 with the belt strap attach end pointing towards the neck 2 which has a hole 33 for attaching the strap 17 (FIG. 2). Cover 26 also serves as a retainer to keep bell-crank 28 in position.

FIG. 2 shows bell-crank 28 with its short arm 32 inserted through a hole in rod 14 and securely fastened at a 90 degree angle to arm 31 which is then inserted into a slip-fit cavity 25 in body 1 at each end of rod 14 so that it may pivot freely. To arm 32 of bell-crank 28 is attached an internally threaded element 13 by a slip-fit clevis type joint with a slip-fit pin 20 so that it may pivot freely. An externally threaded element 12 is fitted into element 13, these two components allow for adjustments on the linkage when required. To the lower end of element 12 is located a plate 15 by clevis type fitting with a slip-fit pin 21 so that plate 15 may pivot freely. To the lower side of plate 15 is attached plate 16 with a slip-fit pin 22 that it may pivot freely. To the three holes in plates 15 and 16 (see FIG. 3) are attached hardened wires 11 and 35 by inserting them through the holes and bending them around. Opposite end of wires 11 and 35 are inserted through slip-fit holes in arm 36 of lever 8 and securely fastened with clamping ferrules 18. Lever 8 is sandwiched between two plates 6 with a slip-fit pin 7 in lever 8 and press-fit in plate 6 allowing lever 8 to pivot freely. This assembly of lever 8 and plate 6 (of which six is required) are secured to plate 5 with screws 19 that slide between plate 6 freely and screw into plate 5 with their heads resting on plates 6. This allows for adjustment in setting the harmonics of each string when required by sliding the assembly in the direction required. Plate 5 is securely fastened to guitar body 1 by conventional wood screws (not shown). An externally threaded screw with a knurled head 9 is fitted between plates 6 and screwed into plate 5, extending back to arm 23 of lever 8. This screw (of which six are required) is the tuning screw for setting the low pitch of each string to be stretched. Spring 10 is to keep screw 9 from vibrating out of position. Also shown are two magnetic pickups 3.

Figure 4:
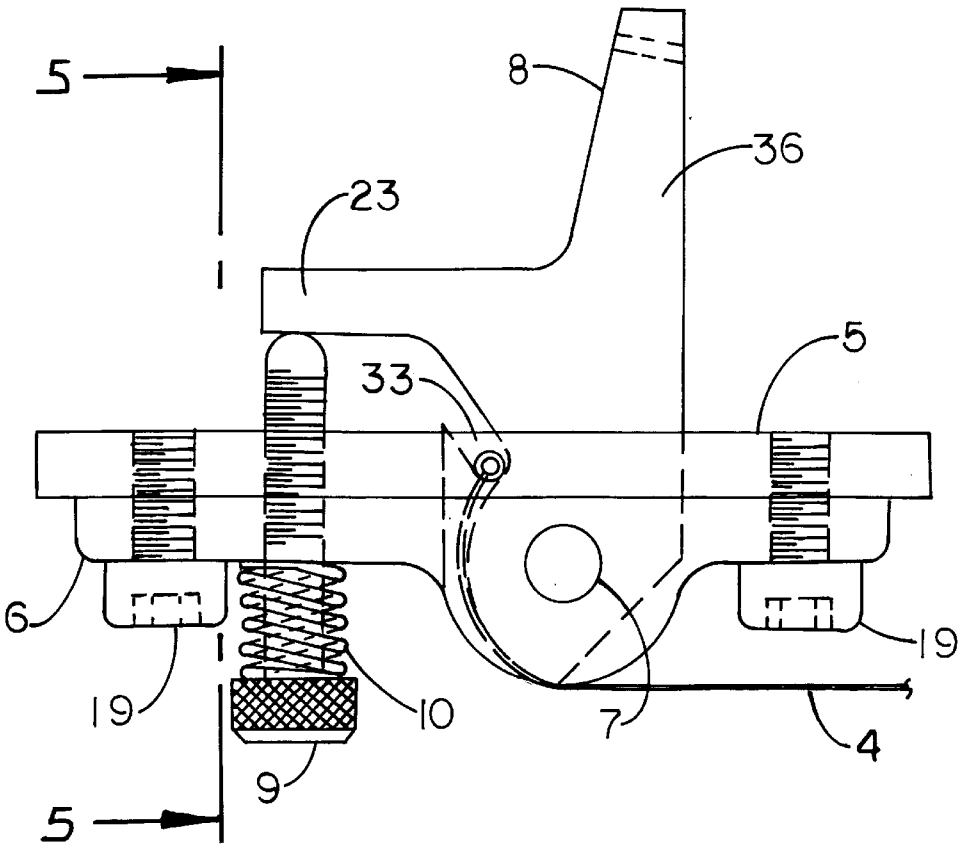
FIG. 4 is an enlarged fragmentary view taken along line 4—4 of FIG. 3 to more clearly define some of the components.
Figure 5:
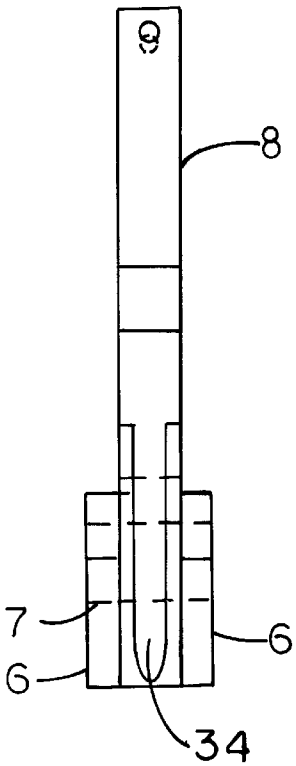
FIG. 5 is an enlarged fragmentary view taken along line 5—5 of FIG. 4 to more clearly define components of FIG. 4.

To tune the guitar, the guitarist with strap 17 connected to his belt gently pushed the neck 2 of the guitar away from him, actuating belt-crank lever 28 by pulling it backwards, thus actuating lever 8 by means of linkage (components 11, 12, 13, 15, 16, and 35) stretching string 4 which is connected in a slot 33 (FIG. 4) and a groove 34 (FIG. 5) and held in position by the small ring that is attached to one end of the guitar string 4, the other end being attached to tuning keys (not shown) on neck head 30 thus pulling arm 23 of lever 8 against step 24 of recess in body 1, this being the extreme position of stretching of the strings of the guitar that are to be stretched. Strings are then tuned to their high pitch, one-half or full step, with the tuning keys that are on the neck head 30. Then the guitarist releases the neck and the tension of strings 4 pulls arm 23 of lever 8 back against tuning screws 9, then strings 4 are then tuned to standard (or low) pitch with screws 9.

Guitar strings by their nature of type and gauge would require each string to be stretched to a different length. To allow for this, after tuning strings to their high pitch, rocker plates 15 and 16 would allow arm 23 of lever 8 to pull back to a different position, thus allowing tuning of each string to its own respective pitch. The unique feature of these rocker plates is that another rocker plate 16 can be added to opposite end of rocker plate 15 where wire 35 is attached and this would allow for stretching four strings when connected with wires.

Figure 3:
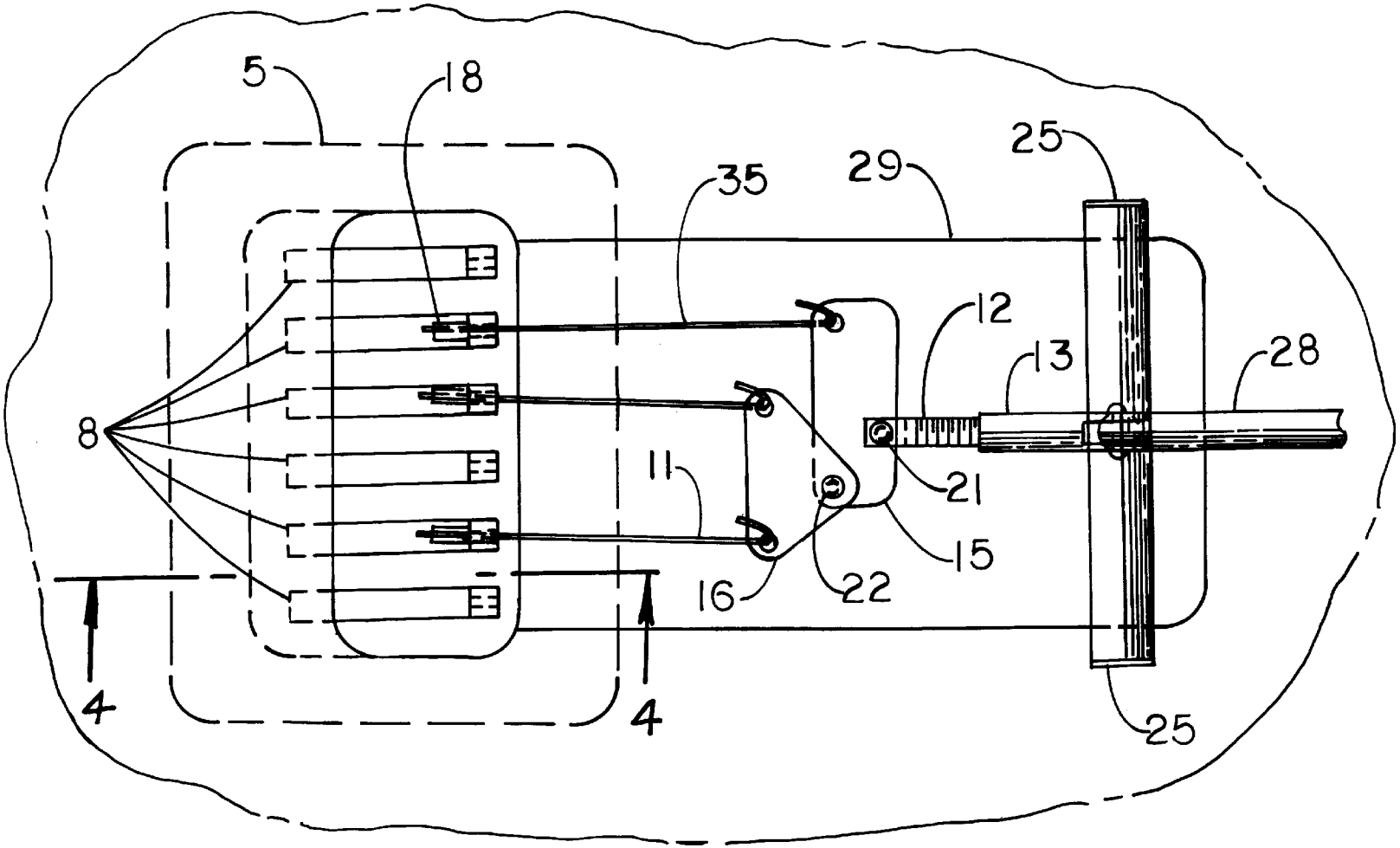
FIG. 3 is a view taken along line 3—3 of FIG. 2 looking into cavity of guitar from the backside with its protective cover removed.

Five strings could be stretched by adding another plate 16 to plate 16 where wire 11 is attached. All six strings could be stretched to different pitches by this method, but most probably three strings would suffice for most guitarists (as shown in FIG. 3).

What I claim is:

1. A mechanism for varying the tension of strings of a musical instrument; the instrument having a front side and a rear side; said mechanism comprising:

a plate mounted on the front side;

a plurality of levers extending perpendicular to said plate from a first end positioned within a cavity of the instrument to a second end extending through and pivotally mounted on said plate; said strings respectively attached to the second ends of the levers; said cavity including a notch;

an arm extending perpendicularly from each of said levers above said notch;

a plurality of adjustable stops threadedly mounted to said plate and respectively engaging said arms such that said stops respectively limit pivoting of the levers in a first direction and said notch limits pivoting of the levers in an opposite second direction;

means for pivoting said levers connected to at least one of said first ends of said levers and extending through the rear side of the instrument.

2. The mechanism according to claim 1, wherein said means for pivoting said levers comprises:

a linkage connected to said at least one of the first ends of the levers;

a bell crank lever pivotally mounted on the rear side of the instrument and connected to said linkage; the bell crank including means for attaching a strap.

3. The mechanism according to claim 2, wherein said linkage includes:

a first plate and a second plate;

said first plate and said second plate pivotally connected.

* * * * *